US006929565B2

(12) United States Patent
Nakahara et al.

(10) Patent No.: US 6,929,565 B2
(45) Date of Patent: Aug. 16, 2005

(54) GOLF CLUB HEAD

(75) Inventors: Norihiko Nakahara, Hiratsuka (JP); Yoh Nishizawa, Hiratsuka (JP); Tomoaki Mori, Hiratsuka (JP); Shinji Yamamoto, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 10/274,960

(22) Filed: Oct. 22, 2002

(65) Prior Publication Data

US 2003/0083151 A1 May 1, 2003

(30) Foreign Application Priority Data

Oct. 24, 2001 (JP) ..... 2001-326183

(51) Int. Cl.[7] ..... A63B 53/04
(52) U.S. Cl. ..... 473/345; 473/349
(58) Field of Search ..... 473/324, 345, 473/346, 349, 350, 290, 291

(56) References Cited

U.S. PATENT DOCUMENTS 4,545,580 A * 10/1985 Tomita et al. ..... 473/332
4,824,110 A * 4/1989 Kobayashi ..... 473/332
5,009,425 A * 4/1991 Okumoto et al. ..... 473/348
5,255,913 A * 10/1993 Tsuchida ..... 473/329
5,425,538 A * 6/1995 Vincent et al. ..... 473/342
5,447,311 A * 9/1995 Viollaz et al. ..... 473/342
5,516,107 A * 5/1996 Okumoto et al. ..... 473/346
5,624,331 A * 4/1997 Lo et al. ..... 473/345
2004/0116207 A1 6/2004 Shiell et al.
2004/0116208 A1 6/2004 Shiell et al.

FOREIGN PATENT DOCUMENTS

JP 05-168731 7/1993
JP 11-004919 1/1999
JP 2000-229135 8/2000

* cited by examiner

*Primary Examiner*—Sebastiano Passaniti
(74) *Attorney, Agent, or Firm*—Finnegan, Henderson, Farabow, Garrett & Dunner, L.L.P.

(57) ABSTRACT

A golf club head capable of obtaining both vibration damping performance and pleasant hitting sound by combining materials different in kind. This golf club head has a hollow structure, and a constitution where fiber reinforced plastic having a mass ratio of 4% or more in the entire head is used for at least one of neck, face, sole, crown and side portions, and the rest is made of metal. An outer shell of the hollow structure includes both of a part made of only metal and a part made of only fiber reinforced plastic.

8 Claims, 8 Drawing Sheets

GOLF CLUB HEAD

BACKGROUND OF THE INVENTION

The present invention relates to a golf club head having a hollow structure. More specifically, the invention relates to a golf club head capable of obtaining both vibration damping performance and pleasant hitting sound by combining materials different in kind.

In the golf club head, in addition to improvements on performance regarding a carry, directionality and the like, and strength, damping of vibration and generation of pleasant sound at the time of hitting a ball are required. Such is required because slight vibration or hitting sound greatly affects a result in golf that is a mental sport.

For example, Japanese patent application Kokai publication No. 11-4919 discloses a golf club head having a hollow structure, which is made of fiber reinforced plastic (FRP). Such a golf club head made of FRP is advantageous in vibration damping performance but disadvantageous in hitting sound and a carry. Japanese patent application Kokai publication No. 5-168731 and No. 2000-229135 disclose golf club heads constructed by combining materials different in kind. However, these golf club heads were incapable of obtaining both vibration damping performance and pleasant hitting sound.

SUMMARY OF THE INVENTION

An object of the present invention is to provide a golf club head capable of obtaining both vibration damping performance and pleasant hitting sound by combining materials different in kind.

In order to achieve the object, a golf club head of the present invention has a hollow structure, and a constitution where fiber reinforced plastic having a mass ratio of 4% or more in the entire head is used for at least one of neck, face, sole, crown and side portions, and the rest is made of metal.

In the golf club head having the hollow structure thus constructed, by using the fiber reinforced plastic having the above-described mass ratio for at least one of the neck, face, sole, crown and side portions, and the metal for the rest, it is possible to provide a golf club head having both vibration damping performance and pleasant hitting sound.

According to the present invention, more noticeable advantages of operation are obtained if an outer shell having the hollow structure includes both a part made of only metal and a part made of only fiber reinforced plastic, and if the fiber reinforced plastic is used for the crown portion. For the metal, two or more kinds of metals may be used for different parts. For the fiber reinforced plastic, two or more kinds of fiber reinforced plastics may be used for different parts. If an elastic modulus of fibers used in the fiber reinforced plastic is less than 27 tons/mm$^2$, especially an effect of improving vibration damping performance is larger. If an elastic modulus of fibers used in the fiber reinforced plastic is 27 tons/mm$^2$ or more, especially an effect of improving hitting sound is larger.

BRIEF DESCRIPTION OF THE DRAWINGS

FIG. 1A being a plan view; FIG. 1B a left side view; and FIG. 1C a sectional view taken along the I—I line of FIG. 1A.

FIG. 2A being a plan view; FIG. 2B a left side view; and FIG. 2C a sectional view taken along the II—II line of FIG. 2A.

FIG. 5A being a front view; FIG. 5B a left side view; and FIG. 5C a right side view.

FIG. 7A being a front view; FIG. 7B a left side view; and FIG. 7C a right side view.

FIG. 8A being a plan view; FIG. 8B being a front view; and FIG. 8C a sectional view taken along the VIII—VIII line of FIG. 8A.

FIG. 9A being a plan view; FIG. 9B a left side view; and FIG. 9C a sectional view taken along the IX—IX line of FIG. 9A.

DETAILED DESCRIPTION OF THE PREFERRED EMBODIMENTS

Next, detailed description will be made for the preferred embodiments of the present invention with reference to the accompanying drawings.

Figure 1A:
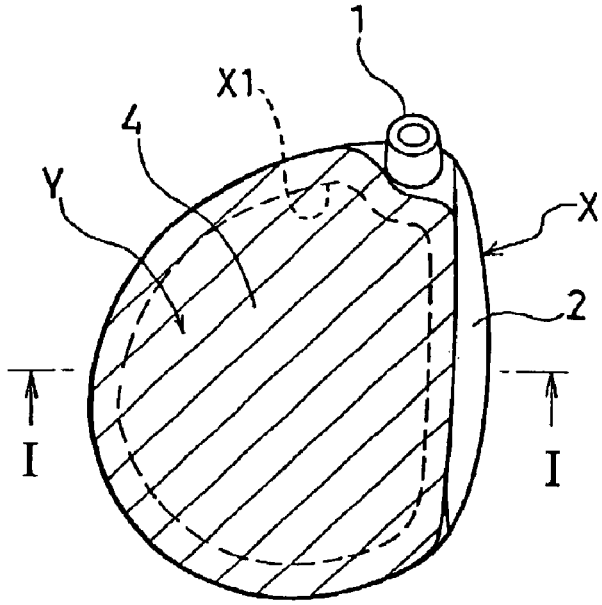
FIGS. 1A to 1C are views showing a golf club head according to an embodiment of the present invention.
Figure 1B:
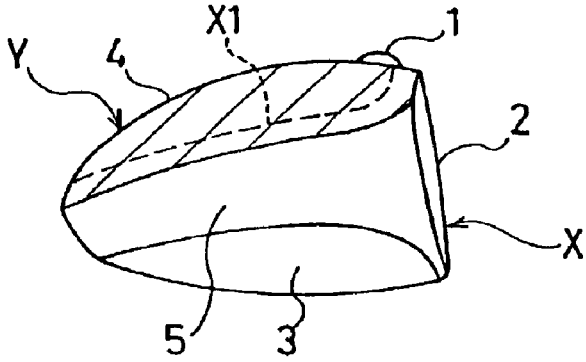
Figure 1C:
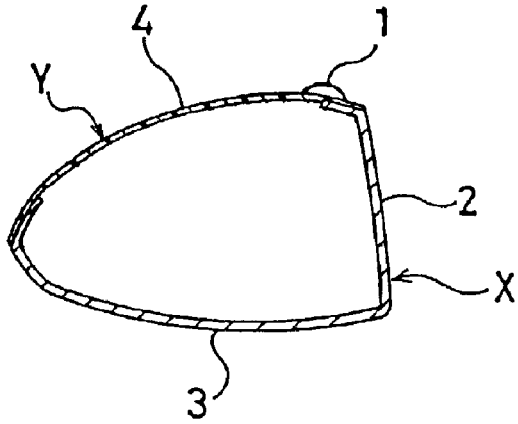

FIGS. 1A to 1C show a golf club head according to an embodiment of the present invention. As shown in FIGS. 1A to 1C, the golf club head of the embodiment has a hollow structure, and a constitution where among neck, face, sole, crown and side portions 1 to 5, the crown portion 4 is made of fiber reinforced plastic (shaded portion), and the rest is made of metal. That is, a metal outer shell member X constituting the neck, face, sole and side portions 1, 2, 3 and 5 has a hole part X1 (through-hole) in a position equivalent to the crown portion 4, and the crown portion 4 is provided with an outer shell member Y made of fiber reinforced plastic, which is arranged to cover at least the hole part X1. Accordingly, in the outer shell having the hollow structure, parts made of only metal are present in the neck, face, sole and side portions 1, 2, 3 and 5, whereas a part made of only fiber reinforced plastic is present in the crown portion 4.

The fiber reinforced plastic is used for at least one of the neck, face, sole, crown and side portions 1 to 5, and the rest is made of metal as described above. Thus, it is possible to constitute a golf club head having both vibration damping performance and pleasant hitting sound. However, a mass ratio [(FRP mass/entire head mass)×100] of the fiber reinforced plastic must be set to 4% or more. If the mass ratio of the fiber reinforced plastic is less than 4%, satisfactory effects of improving vibration damping performance and hitting sound cannot be obtained. Preferably, an upper limit of the mass ratio of the fiber reinforced plastic should be set to 48%. Within this range, a center-of-gravity position of the golf club head can be maintained more suitably.

For the metal, titanium, titanium alloy, stainless steel or the like can be used. In addition, two or more kinds of metals may be used for different parts.

For the fiber reinforced plastic, fiber reinforced plastic is available, which is prepared by impregnating reinforcing fibers such as carbon fibers, glass fibers or alamido fibers with matrix resin such as epoxy resin, unsaturated polyester resin or vinyl ester resin, and use of the carbon fibers as the reinforcing fibers is particularly preferable. In addition, two or more kinds of fiber reinforced plastics may be used for different parts. If an elastic modulus of fibers used in the fiber reinforced plastic is less than 27 tons/mm$^2$, an effect of improving vibration damping performance is increased. If the elastic modulus of fibers used in the fiber reinforced plastic is 27 tons/mm$^2$ or more, an effect of improving hitting sound is increased.

Figure 2A:
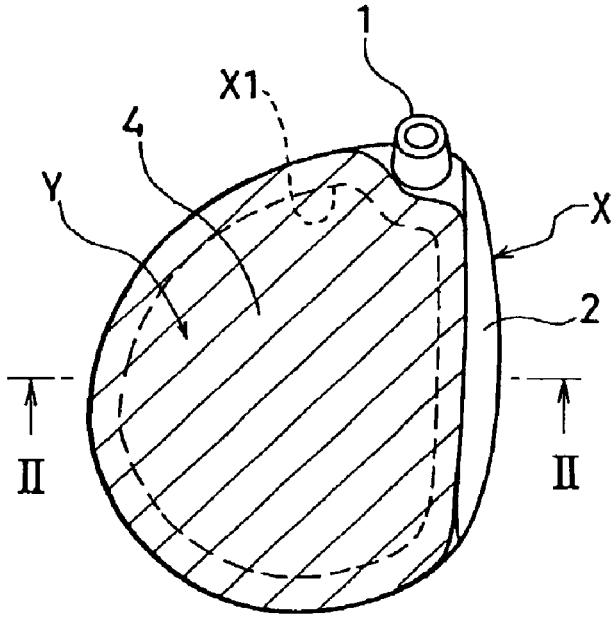
FIGS. 2A to 2C are views showing a modified example of the golf club head of FIGS. 1A to 1C.
Figure 2B:
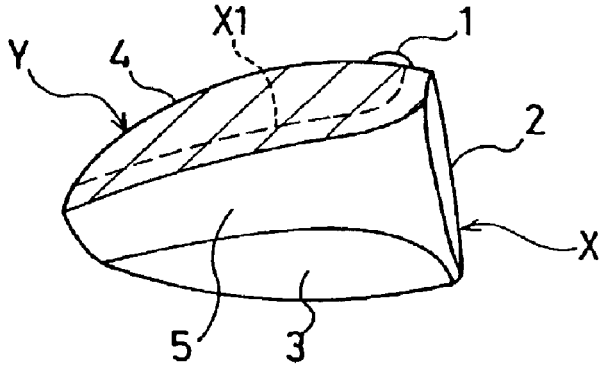
Figure 2C:
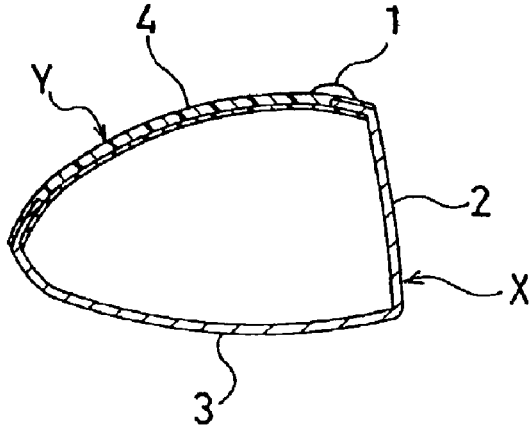
Figure 3A:
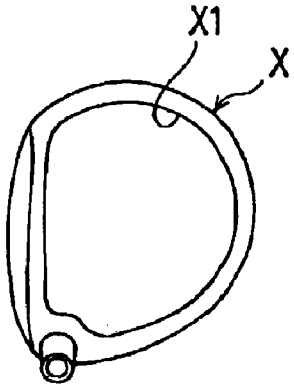
FIGS. 3A to 3L are plan views showing other modified examples of the golf club head of FIGS. 1A to 1C in a state where outer shell members made of fiber reinforced plastics are removed.
Figure 3B:
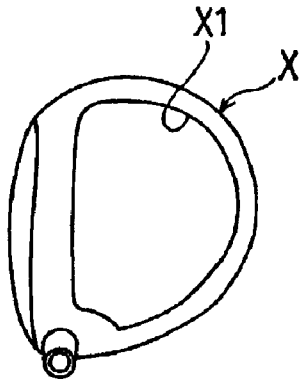
Figure 3C:
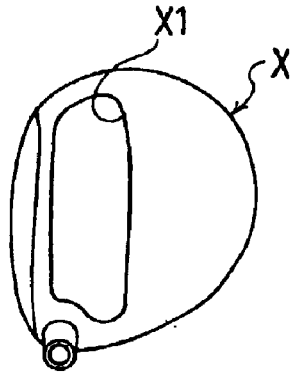
Figure 3D:
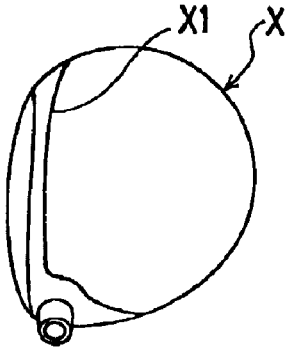
Figure 3E:
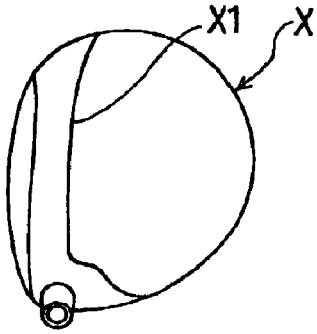
Figure 3F:
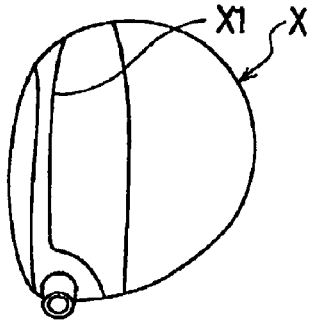
Figure 3G:
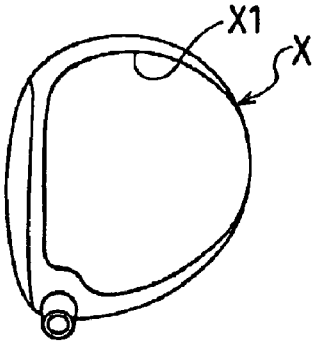
Figure 3H:
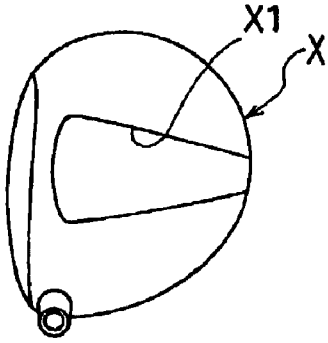
Figure 3I:
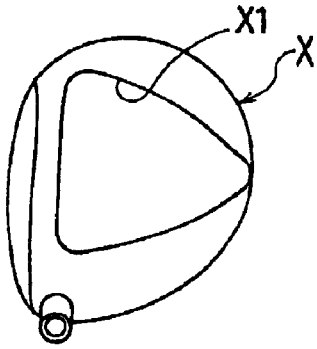
Figure 3J:
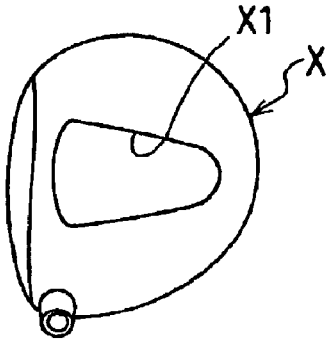
Figure 3K:
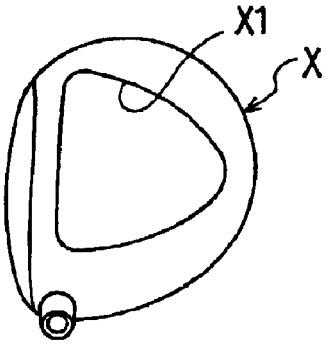
Figure 3L:
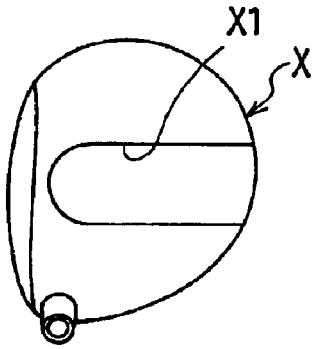

The outer shell member Y made of the fiber reinforced plastic, constituting the crown portion 4, can be adhered to the metal outer shell member X constituting the neck, face, sole and side portions 1, 2, 3 and 5. In FIG. 1A, the outer shell member Y of a single layer structure is stuck to the crown portion 4 of the outer shell member X from the outside. However, the outer shell member Y made of the fiber reinforced plastic may be formed in a multilayered structure of two layers or more. For example, as shown in FIGS. 2A to 2C, the outer shell member Y made of the fiber reinforced plastic can be formed in a double layer structure, and these layers can be stuck from the inside and the outside so as to cover the hole part X1 of the outer shell member X. In this case, the outer shell member Y made of the fiber reinforced plastic can be firmly fixed to the metal outer shell member X.

Figure 4A:
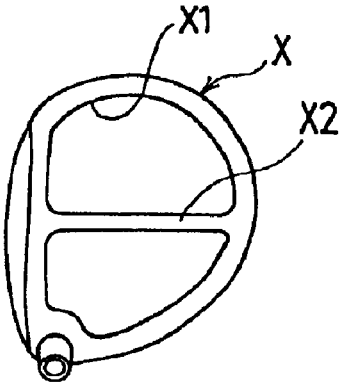
FIGS. 4A and 4B are plan views showing still other modified examples of the golf club head of FIGS. 1A to 1C in a state where outer shell members made of fiber reinforced plastics are removed.
Figure 4B:
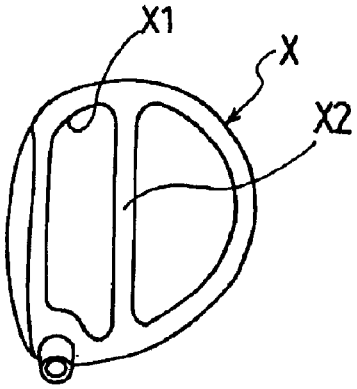

In the embodiment described above, no particular limitation is placed on a shape of the hole part X1 opened in the metal outer shell member X constituting the neck, face, sole and side portions 1, 2, 3 and 5, and various shapes can be selected in accordance with intended vibration damping performance and hitting sound. For example, the hole part X1 may be formed in one of optional shapes shown in FIGS. 3A to 3L. Alternatively, as shown in each of FIGS. 4A and 4B, a bridge X2 may be provided to traverse the hole part X1, and the outer shell member Y made of the fiber reinforced plastic may be supported by this bridge X2. There should be no particular limitation placed on the number of bridges X2, and two or more bridges may be provided as occasion demands.

Figure 5A:
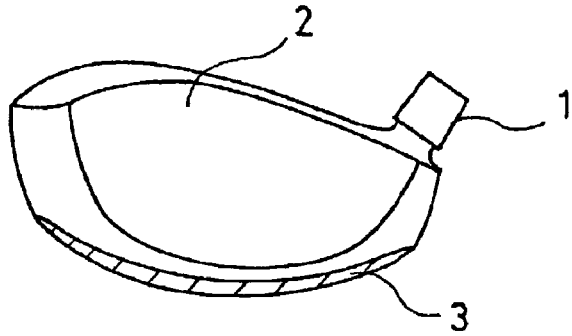
FIGS. 5A to 5C are views showing a golf club head according to another embodiment of the present invention.
Figure 5B:
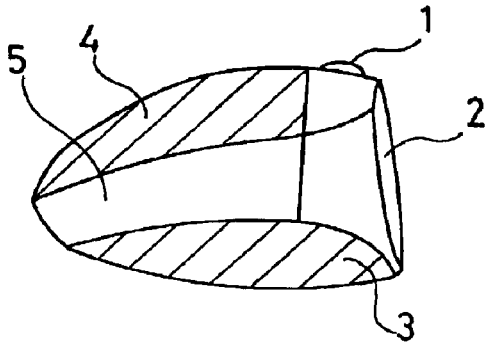
Figure 5C:
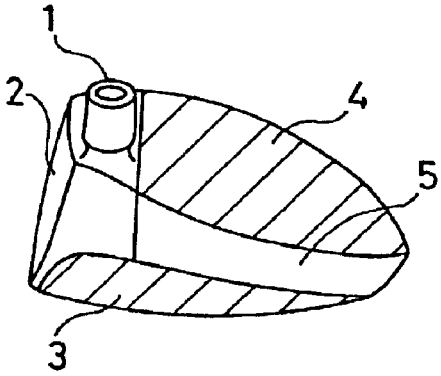
Figure 6:
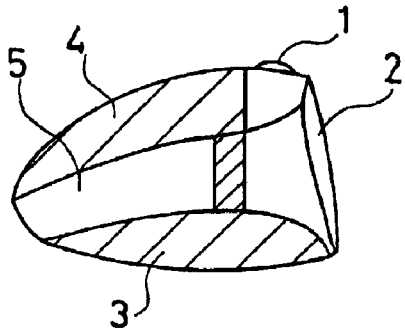
FIG. 6 is a left side view showing a modified example of the golf club head of FIGS. 5A to 5C.

FIGS. 5A to 5C show a golf club head according to another embodiment of the present invention. The golf club head of this embodiment has a hollow structure, and a constitution where sole and crown portions 3 and 4 are made of fiber reinforced plastics (shaded portions), a side portion 5 is made of stainless steel, and neck and face portions 1 and 2 are made of titanium. In this case, as shown in FIG. 6, fiber reinforced plastic may be provided for joining between the side portion 5 made of stainless steel and the neck and face portions 1 and 2 made of titanium.

As other examples of the above-described use of two or more metals, available to be exemplified are the examples which include a golf club head having a crown portion made of FRP, sole and side portions made of stainless steel, and neck and face portions made of titanium, a golf club head having a crown portion made of FRP, a side portion made of stainless steel, and neck, face and sole portions made of titanium, a golf club head having a crown portion made of FRP, neck, sole and side portions made of stainless steel, and a face portion made of titanium, a golf club head having a crown portion made of FRP, neck and side portions made of stainless steel, and face and sole portions made of titanium, and the like.

Figure 7A:
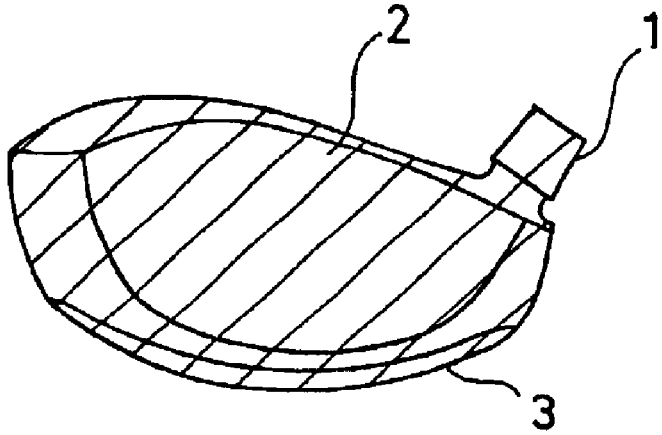
FIGS. 7A to 7C are views showing still another embodiment of the present invention.
Figure 7B:
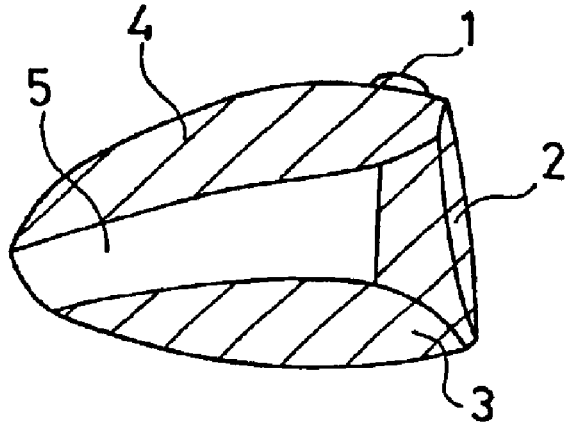
Figure 7C:
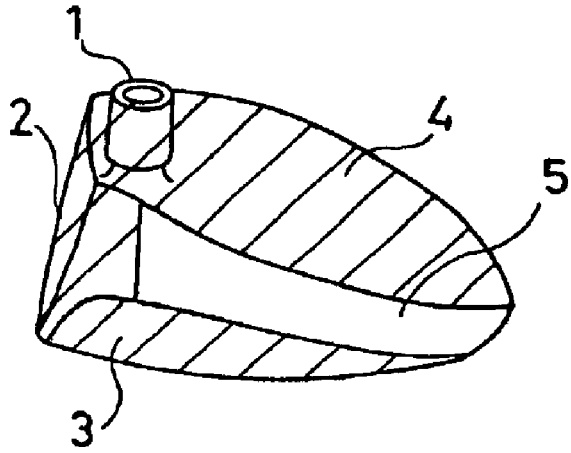

FIGS. 7A to 7C show a golf club head according to still another embodiment of the present invention. The golf club head of this embodiment has a hollow structure, and a constitution where neck, face, sole and crown portions 1 to 4 are made of fiber reinforced plastics (shaded portions), and a side portion 5 is made of stainless steel.

As other examples of the above-described use of metal for only one member, available to be exemplified are the examples which include a golf club head having neck, face, crown and side portions made of FRP, and a sole portion made of stainless steel, a golf club head having a face portion made of FRP, and neck, sole, crown and side portions made of titanium, a golf club head having neck, sole, crown and side portions made of FRP, and a face portion made of titanium, and the like.

Figure 8A:
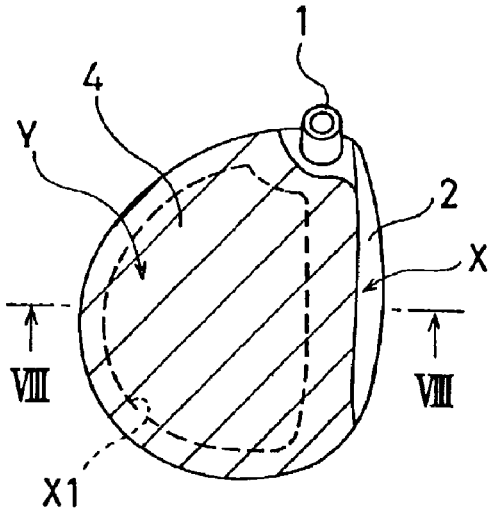
FIGS. 8A to 8C are views showing a golf club head according to still another embodiment of the present invention.
Figure 8B:
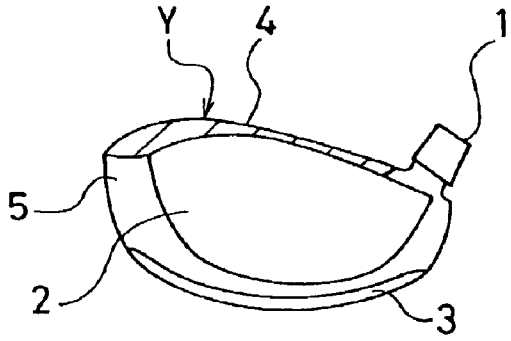
Figure 8C:
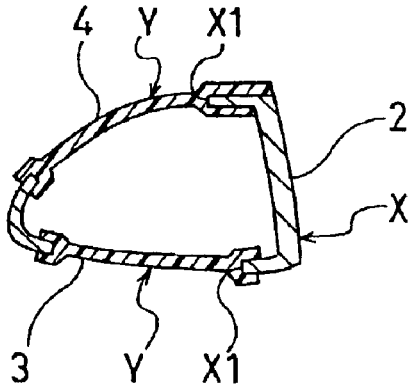

FIGS. 8A to 8C show a golf club head according to still another embodiment of the present invention. The golf club head of this embodiment has a hollow structure, and a constitution where sole and crown portions 3 and 4 are made of fiber reinforced plastics (shaded portions), and neck, face and side portions 1, 2 and 5 are made of metal. That is, a metal outer shell member X constituting neck, face and side portions 1, 2 and 5 has hole parts X1, X1 (through-hole) in respective portions equivalent to sole and crown portions 3 and 4, and outer shell members Y made of fiber reinforced plastic are disposed so as to cover the hole parts X1, X1. The outer shell members Y made of fiber reinforced plastic are fixed to the metal outer shell member X in a manner that the edges of the member X are put in the shell members Y.

Figure 9A:
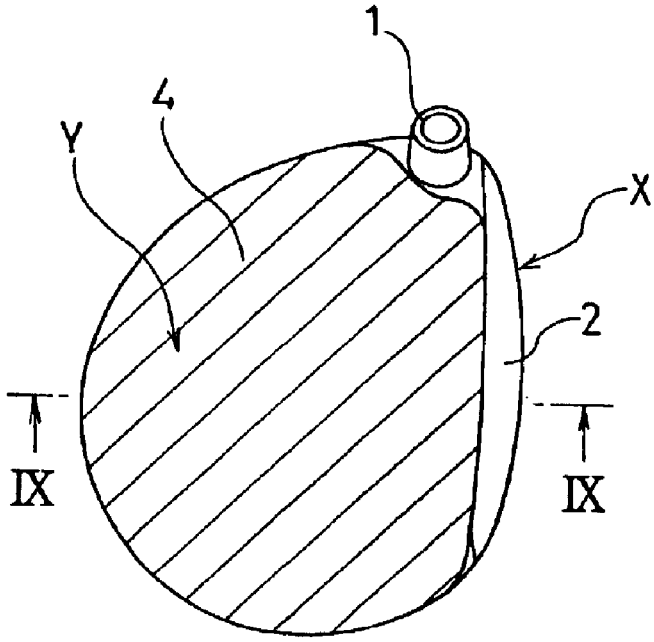
FIGS. 9A to 9C are views showing a golf club head according to still another embodiment of the present invention.
Figure 9B:
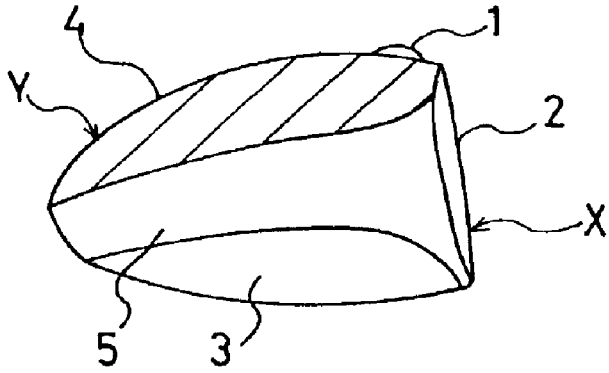
Figure 9C:
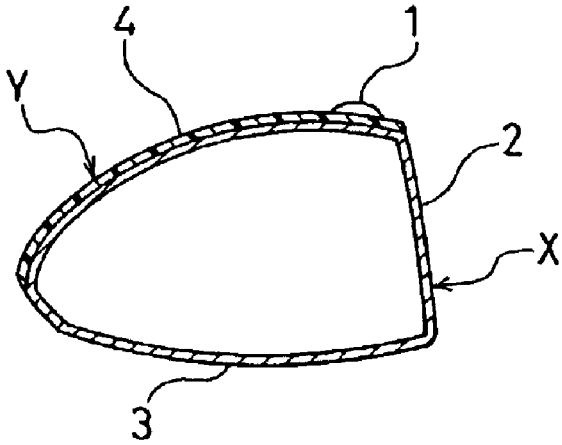

FIGS. 9A to 9C show a golf club head according to still another embodiment of the present invention. As shown in FIGS. 9A to 9C, the golf club head of this embodiment has a hollow structure composed of a metal outer shell member X, which constitutes neck, face, sole, crown and side portions 1 to 5, and an outer shell member Y made of fiber reinforced plastic (shaded portion) is laminated on the crown portion 4.

Even when the outer shell member Y made of the fiber reinforced plastic is laminated on at least one place of the hollow structure composed of the metal outer shell member X constituting the neck, face, sole, crown and side portions 1 to 5 as described above, it is possible to provide a golf club head having both vibration damping performance and pleasant hitting sound. Also in this case, a mass ratio [(FRP mass/entire head mass)×100] of the fiber reinforced plastic must be set to 4% or more.

EXAMPLE

With regard to a golf club head having a hollow structure, the inventors prepared comparative examples 1 and 2 and examples 1 to 8, where materials for neck, face, sole, crown and side portions were varied as shown in Table 1. In Table 1, "Ti" represents titanium or titanium alloy, "SUS" stainless steel, and "FRP" fiber reinforced plastic. In addition, "<27t" means use of fiber reinforced plastic (fiber: carbon) having a fiber elastic modulus of less than 27 tons/mm$^2$, and "≧27t" use of fiber reinforced plastic (fiber: carbon) having a fiber elastic modulus of 27 tons/mm$^2$ or higher. Description of both metal and FRP means a case where FRP is laminated on/under the metal.

Golf clubs having the above golf club heads fixed thereto were prepared, and vibration damping performance and hitting sound were evaluated through trial hitting by ten golfers. Table 1 shows results thereof. The results of the evaluation are shown by indexes with the comparative example 1 set to an index of 100. For vibration damping performance, a larger index value means a larger effect of damping vibration. For hitting sound, a larger index value means better sound, i.e., generation of hitting sound intermediate between metal sound and persimmon sound.

TABLE 1

| | Neck portion | Face portion | Sole portion | Crown portion | Side portion | Mass ratio (%) (FRP/total mass) | Vibration damping performance | Hitting sound |
|---|---|---|---|---|---|---|---|---|
| Comparative example 1 | Ti | Ti | Ti | Ti | Ti | 0 | 100 | 100 |
| Comparative example 2 | Ti | Ti | Ti | FRP (<27t) | Ti | 1 | 101 | 101 |
| Example 1 | Ti | Ti | Ti | Ti, FRP (<27t) | Ti | 5 | 102 | 104 |
| Example 2 | Ti | Ti | Ti | Ti | FRP (<27t) | 5 | 103 | 107 |
| Example 3 | Ti | Ti | Ti | FRP (<27t) | Ti | 5 | 109 | 117 |
| Example 4 | Ti | Ti | Ti | FRP (<27t) | SUS | 5 | 107 | 111 |
| Example 5 | Ti | Ti | FRP (≧27t) | FRP (<27t) | Ti | 5 | 111 | 112 |
| Example 6 | Ti | Ti | Ti | FRP (≧27t) | Ti | 5 | 110 | 118 |
| Example 7 | Ti | Ti | FRP (<27t) | FRP (<27t) | Ti | 15 | 115 | 116 |
| Example 8 | Ti | Ti | FRP (<27t) | FRP (<27t) | Ti | 38 | 120 | 115 |

As can be understood from Table 1, vibration damping performance and hitting sound were improved in all the golf club heads of the examples 1 to 8 compared with the comparative example 1. In the comparative example 2, satisfactory effects were not obtained because only a small amount of fiber reinforced plastic was used.

According to the present invention, in the golf club head having the hollow structure, the fiber reinforced plastic having a mass ratio of 4% or more in the entire head is used for at least one of the neck, face, sole, crown and side portions, and the rest is made of metal. Therefore, it is possible to constitute a golf club head having both vibration damping performance and pleasant hitting sound.

The preferred embodiments of the present invention have been described in detail. However, it should be understood that various changes, modifications and substitutions can be made without departing from the spirit and the scope of the invention as specified in appended claims.

What is claimed is:

1. A golf club head of the wood type comprising a golf club head having a hollow structure, said hollow structure having a neck portion, a face portion, a sole portion, a crown portion, and a side portion, the neck and face portions being made of metal and the outer surface of the crown portion being made of a fiber reinforced plastic material with the sole and side portions being made of a fiber reinforced plastic material or metal, wherein the crown portion is a two layered structure, an inner layer thereof being made of metal and an outer layer thereof being an outer shell made of said fiber reinforced plastic material, and wherein the fiber reinforced plastic material has a mass ratio of 4% or more with respect to the total mass of the golf club head.

2. The golf club head of claim 1, wherein the inner layer has a hole therein that is covered by said outer shell.

3. The golf club head of claim 1 or 2, wherein for the metal, two or more different kinds of metals are used for different portions of the golf club head.

4. The golf club head of claim 1 or 2, wherein for the fiber reinforced plastic material, two or more different kinds of fiber reinforced plastic materials are used for different portions of the golf club head.

5. The golf club head of claim 1 or 2, wherein an elastic modulus of fibers used in the fiber reinforced plastic material is less than 27 tons/mm$^2$.

6. The golf club head of claim 1 or 2, wherein an elastic modulus of fibers used in the fiber reinforced plastic material is 27 tons/mm$^2$ or more.

7. The golf club head of claim 1 or 2, wherein the sole and side portions are of metal.

8. The golf club head of claim 1 or 2, wherein the sole portion is made of a fiber reinforced plastic material and the side portion is of metal.

* * * * *